United States Patent [19]

Crawford

[11] Patent Number: 4,679,640

[45] Date of Patent: Jul. 14, 1987

[54] METHOD FOR CASE HARDENING ROCK BITS AND ROCK BITS FORMED THEREBY

[75] Inventor: Micheal B. Crawford, Duncanville, Tex.

[73] Assignee: Dresser Industries, Inc., Dallas, Tex.

[21] Appl. No.: 832,490

[22] Filed: Feb. 21, 1986

[51] Int. Cl.[4] ..... E21B 10/52

[52] U.S. Cl. ..... 175/374; 175/409; 175/410; 76/108 A

[58] Field of Search ..... 175/331, 374, 409, 410; 76/108 A; 148/12.1, 16.5

[56] References Cited

U.S. PATENT DOCUMENTS

| | | | |
|---|---|---|---|
| 3,275,389 | 9/1966 | Neilson et al. | 308/8.2 |
| 3,442,342 | 5/1969 | McElya et al. | 175/374 |
| 3,842,921 | 10/1974 | Dill et al. | 175/374 |
| 3,891,474 | 6/1975 | Grange | 148/16.5 |
| 3,946,817 | 3/1976 | Prince | 175/374 |
| 4,012,238 | 3/1977 | Scales | 175/374 |
| 4,021,084 | 5/1977 | Garner | 308/8.2 |
| 4,105,263 | 8/1978 | Sorensen et al. | 308/8.2 |
| 4,108,692 | 8/1978 | Quinlan | 175/374 |
| 4,303,137 | 12/1981 | Fischer | 175/374 |
| 4,499,795 | 2/1985 | Radtke | 76/108 A |
| 4,562,892 | 1/1986 | Ecer | 175/371 |
| 4,597,456 | 7/1986 | Ecer | 175/371 |

*Primary Examiner*—James A. Leppink
*Assistant Examiner*—Terry Lee Melius
*Attorney, Agent, or Firm*—Fred A. Winans

[57] ABSTRACT

In the method of manufacturing case hardened rock bits formed of a previously known conical profile for containing spaced apart cutter inserts in a common circumferential row about the cone, carburizing is applied uniformly over the entire conical surface of the cutter blank. Without removing any of the applied carburizing composition elsewhere, the compact lands are counterbored of diameter slightly larger than the socket cavity to be drilled, and to a depth below the carburized case so as to remove the carburized case thereat. The cutter blank is then hardened after which the insert cavities are drilled concentrically through the previous counterbores followed by a pressing of the individual inserts in an interference fit into the cavities. This results in continuous uninterrupted case hardening in the land areas between adjacent inserts. Also disclosed is a rock bit formed in accordance with the aforesaid method.

15 Claims, 13 Drawing Figures

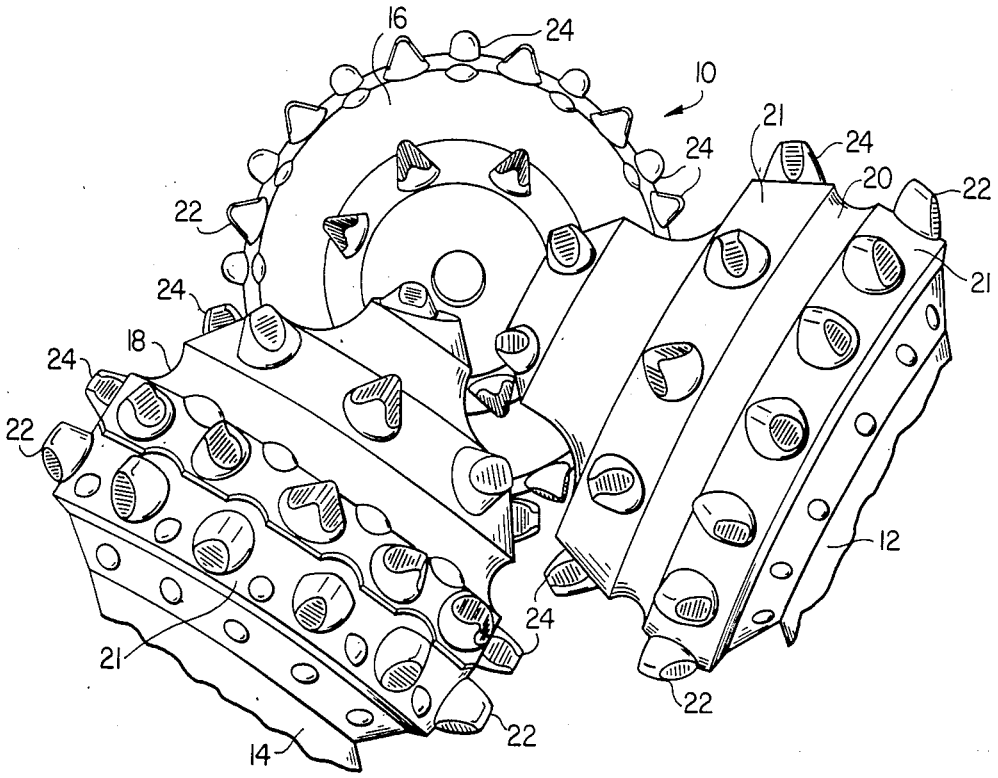
FIG. 1
FIG. 3
(PRIOR ART)
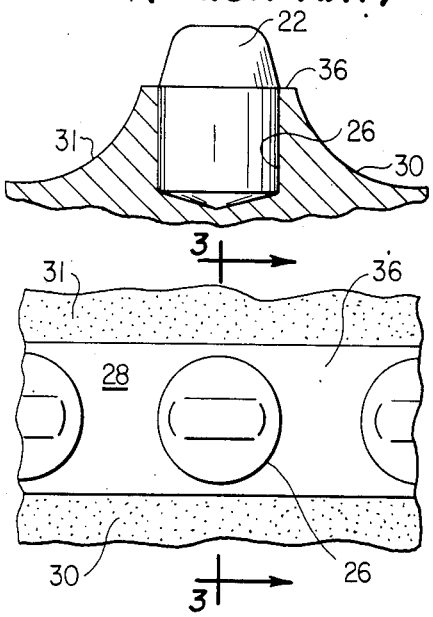
FIG. 2
(PRIOR ART)
FIG. 5
(PRIOR ART)
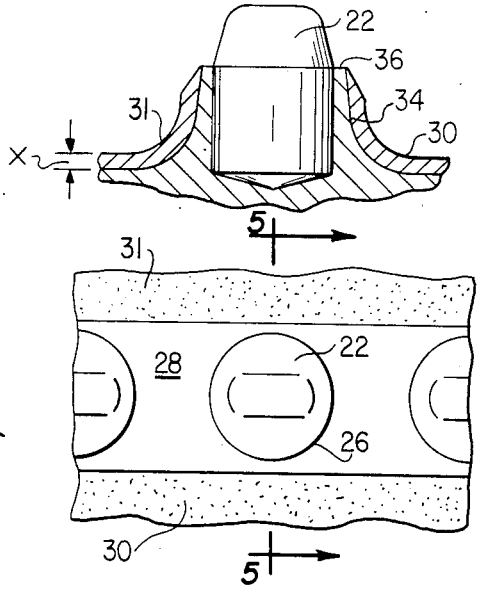
FIG. 4
(PRIOR ART)

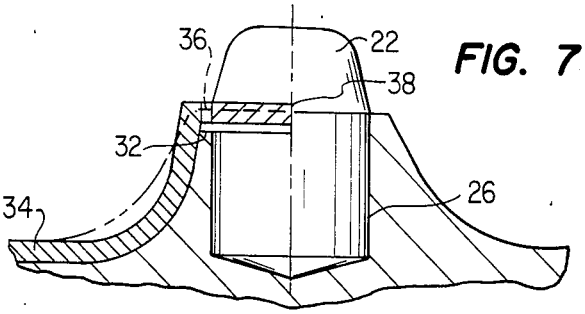
FIG. 7
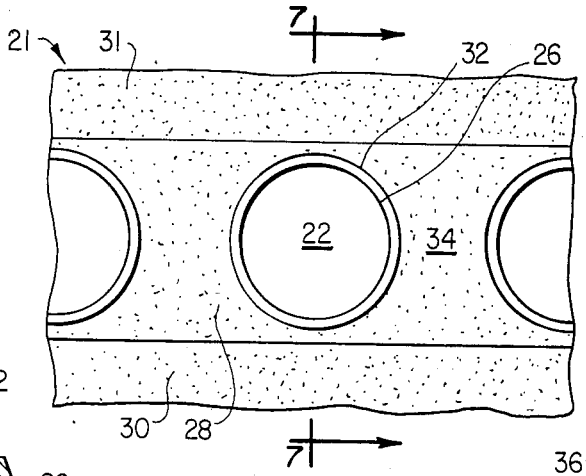
FIG. 6
FIG. 9
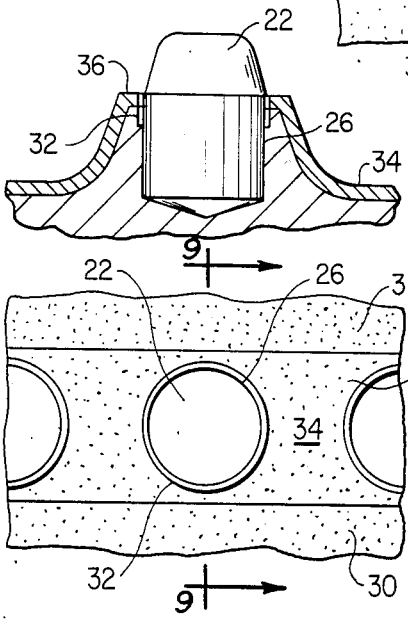
FIG. 8
FIG. 11
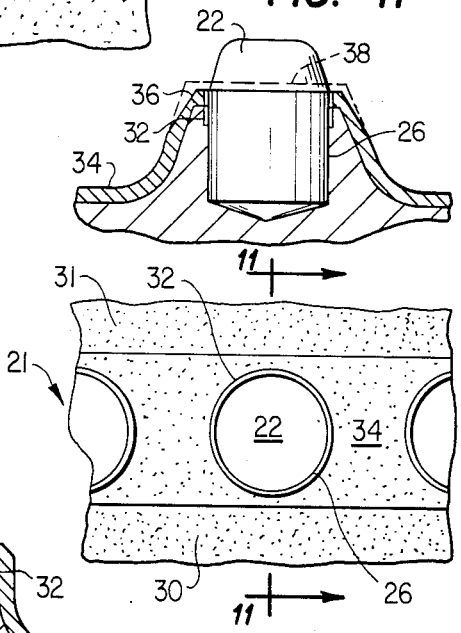
FIG. 10
FIG. 13
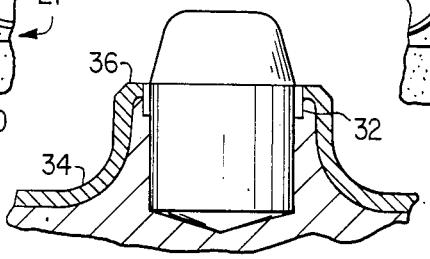
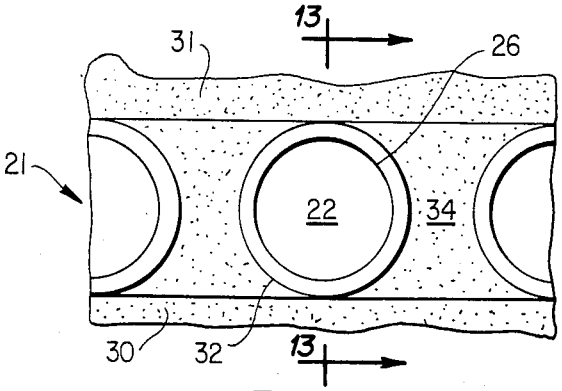
FIG. 12

METHOD FOR CASE HARDENING ROCK BITS AND ROCK BITS FORMED THEREBY

TECHNICAL FIELD

The field of art to which the invention pertains comprises rock bits for earth boring including metallurgical treatment thereof.

BACKGROUND OF THE INVENTION

Since the advent of the rolling cutter rock bit for earth boring, various improvements have contributed to enhanced performance of such bits in the wide variety of earth formations for which such rock bits are utilized. Among the more significant improvements particularly adapted for drilling through hard or abrasive formations has been the use of hard facing materials metallurgically applied about the teeth and cutter surfaces to render these surfaces increasingly resistant to erosion or abrasive wear. This has significantly increased the useful life of such bits and its consequent greater drilling penetration before bit replacement is required. One form of hard facing has been the use of a composite material consisting essentially of an alloy steel matrix in which are dispersed particles of sintered tungsten carbide. The composite material is applied by a welding process in which a steel tube is filled with tungsten carbide particles and ferroalloys are heated to a temperature sufficient to melt the steel tube and fuse the composite to the selected surfaces. Another form of hard facing is disclosed in U.S. Pat. No. 3,842,921 in which the bit surfaces are carburized, followed by boronizing, hardening and then tempering.

For insert type compact rock bits utilizing tungsten carbide inserts, lands are customarily provided in a circumferential row that are drilled to form sockets in which the inserts are press fitted in an interference fit. For processing carburized treated bits preliminary to drilling socket cavities, it has long been the practice to first profile the bit with circumferential lands having extra stock. The entire cone is then carburized after which the circumferential lands are machined to remove the extra stock of the lands to a depth below the carburization. Subsequently, the cone is subjected to metallurgical hardening of those portions on which carburize case has remained. When hardening has been completed cavities for the inserts are drilled into the exposed metal unhardened compact lands to receive the press fit inserts. By this means, i.e., by removing the carburized or hardened stock from the land areas, the potential for strain cracks from the force fit inserts in the relatively inelastic carburized surfaces has thereby been avoided.

As a consequence of the foregoing, the potential for cracking has been eliminated while the majority of the exposed cone surface is case hardened from the applied carburizing. However, the space between adjacent inserts in the common circumferential row from which the carburizing has been removed along with removal of the extra stock is relatively non-hardened and subject to greater erosion from cuttings while drilling than are the more hardened surfaces. The latter is obviously a weak link in the overall structure and detrimental to the cutter as a whole in wanting to preserve the integrity of the cutter unit for maximized earth penetration. Yet despite recognition of the problem, a ready solution therefor has not heretofore been known.

SUMMARY OF THE INVENTION

The invention relates to the manufacture of earth boring rock bits. More specifically, the invention relates to a method of manufacture including the metallurgical treatment of earth boring rock bits in the course of manufacture in which the common circumferential row containing the insert lands is case hardened along the surface between adjacent inserts similarly as the other remaining surfaces of the rock bit. This thereby affords substantially equal protection to the lands thereat from erosion or abrasion when drilling comparable with that afforded to the other cutter surfaces.

The foregoing is achieved in accordance with the invention by a series of sequential steps in the method of manufacture unlike that of the prior art that results in case hardening between adjacent inserts in a common circumferential row. More specifically, in accordance with a preferred aspect of the invention, the method hereof involves a series of sequential steps beginning with a cutter cone blank which has been preprofiled similar to that previously utilized with or without the extra stock. The entire conical cutter surface is first carburized after which selected compact land areas are locally machined to remove the carburizing thereat. In a preferred form, machining is in the form of a radially inward counterbore of diameter slightly larger than the intended cavity size that is extended through each compact land to a depth below the carburized case. The remaining carburized portions of the cutter surfaces are then hardened after which the insert cavities are drilled into the compact land within the non-hardened counterbore for receipt of the inserts force fit therein. Optionally, the cones can be hardened before counterboring.

As a consequence of the foregoing, the previous problem associated with an absence of case hardening between inserts is readily eliminated by a changed order of sequential processing steps that enables case hardening of the intervening land to be preserved and retained for providing its intended purpose during the utlimate earth boring for which the cutter is to be utilized. At the same time, the potential problem of surface cracking from the force fit of inserts into their receiving cavities is avoided by drilling the cavities into the larger non-hardened counterbores.

It is therefore an object of the invention to effect a novel method for metallurgical surface treatment in the manufacture of rock bits.

It is a further object of the invention to provide a novel rock bit construction resulting from the method of the previous object.

It is a still further object of the invention to effect the preceding objects by a relatively simple sequence of steps unlike that utilized in the manufacture of such bits of the prior art.

BRIEF DESCRIPTION OF THE DRAWINGS

FIG. 1 is a cutaway perspective illustration of a type of three cone rolling cutter bit in which the present invention is embodied;

FIG. 2 is a fragmentary plan view of an uncarburized standard profile circumferential insert row in accordance with the prior art;

FIG. 3 is a sectional view as seen substantially from the position 3—3 of FIG. 2;

FIG. 4 is a fragmentary plan view of a carburized circumferential insert row constructed in accordance with the prior art;

FIG. 5 is a sectional view as seen substantially along the lines 5—5 of FIG. 4;

FIG. 6 is a fragmentary plan view of a circumferential insert row metallurgically carburized in accordance with a first embodiment of the invention;

FIG. 7 is a sectional view as seen substantially from the position 7—7 of FIG. 6;

FIGS. 8-9 are plan and sectional views generally corresponding to FIGS. 6-7 respectively for a second embodiment of the invention;

FIGS. 10-11 are plan and sectional views generally corresponding to FIGS. 6-7 respectively for a third embodiment of the invention; and FIGS. 12-13 are plan and sectional views generally corresponding to FIGS. 6-7 respectively for a fourth embodiment of the invention.

Referring now to the drawings and to FIG. 1 in particular, a rotary rock bit embodying the present invention is illustrated and is generally designated by the reference character 10. The bit includes a body to be connected at its pin end to the lower end of a drill string (not shown) and a passage (not shown) providing communication for drilling muds or the like passing downwardly through the drill string. In this manner drilling mud is directed to the bottom of the well bore and passes upwardly in the annulus between the wall of the well bore and the drill pipe carrying cuttings and drilling debris therewith.

Depending from the body of the bit are three substantially identical arms with arms 12 and 14 being illustrated. The lower end portion of each of the arms is provided with a conventional bearing pin and each arm in turn rotatably supports a generally conical cutter member designated 16, 18 and 20. The bearing pins carrying the cutting members define axes of rotation respectively about which the cutter members rotate on axes tilted downwardly and inwardly at a predetermined angle.

Each of the cutter members 16, 18, and 20 includes a nose portion that is oriented toward the bit axis of rotation and a base that is positioned at the intersection between the wall of the well bore and the bottom thereof. Each of the cutter members likewise includes an annular circumferential row 21 in accordance with the invention as will be described containing inserts 22 located adjacent the base of each cutting member. Each of the cutter members 16, 18 and 20 likewise include at least one annular row of inserts 24 similar to insert 22 and operative for destroying the inner portion of the hole as is known in the art.

As shown in FIGS. 2-3, the standard profile for an uncarburized annular row 21 of the prior art is comprised of base metal land 28 containing compact lands 36 in which inserts 22 have been press fitted into cavities 26. Circumferentially enclosing land 28 are annular recesses 30 and 31 the surfaces of which are slightly depressed below land 28.

Referring to the prior art carburized configurations of FIGS. 4 and 5, there is illustrated a profile similar to FIGS. 2-3 on which a metallurgical carburized case 34 has been applied. It is important to note with respect to these FIGS. as will be further described, that while recess ribbons 30 and 31 contain carburized case 34, land 28 intermediate the inserts 22 is devoid of carburizing 34 having been removed along with removal of the extra stock described supra.

Carburizing as referred to herein is well known in the art. Gas carburizing for example is described on pages 93-114 of Vol. 2 of the 8th Edition of the *Metals Handbook,* "Heat Treating, Cleaning and Finishing" (1964 American Society for Metals). Pack carburizing is likewise known in the art and described for example on pages 114-118 of Vol. 2 of the *Metals Handbook.* Likewise, liquid carburizing is known as described for example on pages 133-145 of Vol. 2 of the *Metals Handbook.* By whatever technique is utilized to effect carburizing, the initially applied carburized surface is subjected to controlled conditions of temperature for a predetermined period of time in an appropriate chemical environment to produce the carburized case 34 imposed on recess ribbons 30 and 31. After application of the carburized case is completed, the entire surface may optionally be boronized followed by hardening and tempering as is customary in the art.

It will be appreciated that the cone structure containing annular rows 21 as illustrated in FIGS. 4 and 5 were processed in the course of manufacture in a sequence that began with a bit profile like that of FIGS. 2-3 and with the circumferential land 28 having a extra stock on which the carburizing 34 had been applied. The cone was then machined and re-given a second or "double profiling" operation as is well known in the art to remove the carburizing and extra stock from lands 28 to a depth below the carburization. Typically the carburized case is about 0.080-0.100 inches in thickness. Thereafter the case was subjected to a hardening process before drilling the holes to form socket cavities 26 in which the inserts 22 were forced into an interference fit. The method sequence just stated enables drilling of socket cavities 26 directly into relatively soft metal as compared to the significantly greater hardness of the adjacent hardened case. As can be appreciated, however, with reference to FIG. 4 the resulting lands 28 are in a non carburized and relatively unhardened state capable of being eroded from cutting during subsequent utilization of the bit in the course of earth boring.

Referring now to FIGS. 6-13, there is illustrated the carburized cone structure produced in accordance with the invention in which the lands 28 between ribbon recess areas 30 and 31 are entirely carburized to provide previously unavailable erosion protection from land wear and/or compact breaking with associated insert fallout. This construction thereby serves to extend the rock bit life beyond the life previously shortened prematurely by land erosion or abrasion.

Referring specifically to FIGS. 6-7, the profile of annular row 21 is assumed to correspond with the standard profile described above. For processing in accordance with the invention, the entire cutter including annular row 21 received carbon pack 34 before hardening is undertaken, after which each compact land in the softer state is machined in the form of a counterbore 32 to a depth below the carburized case. This removes the case thereat and the entire cutter is subsequently subjected to metallurgical hardening after which the relatively soft metal counterbores are concentrically drilled to form socket cavities 26 for receipt of press fit inserts 22. This processing sequence, unlike that described above for the prior art results in the land areas 28 between adjacent inserts containing the hardened carburized case for achieving a uniform carburized surface throughout to realize an erosion protection for lands 28 that was previously unavailable.

For purposes of this embodiment, the cone would be profiled with additional stock 38 over compact land 36 some or all of which could be subsequently machined off depending on the intended thickness of case 34 being sought. The outside diameter is carburized and annealed and, as previously described, counterbore 32 removes the carburizing about the axis of cavity 26 which is drilled subsequently. The cones are likewise quenched and hardened before being drilled to receive the pressed insert 22 after which the cutter is finished as per pre-existing procedures. The diameter of counterbore 32 for the purposes hereof are at least greater than the interference fit between insert 22 and cavity 26. Typically in accordance herewith the counterbores are of a diameter about 0.015 inches over the size of cavity 26 as to avoid the imposition of surface stress thereat from the interference fit between insert and cavity.

Referring now to the remaining FIGS. 8–13, there is shown in various embodiments, consistent results produced by the method of the invention in which the entire land 28 between the recesses 30 and 31 and between adjacent inserts contain a carburized case in accordance with the invention hereof. This can be readily seen in the embodiment of FIGS. 8–9 formed without the benefit of utilizing additional metal stock over the compact land 36. In the embodiment of FIGS. 10–11 additional stock 38 was included initially and then machined off for producing the desired thickness of case 34 thereabout. In the embodiment of FIGS. 12–13 the top surface of the compact lands 36 are milled as illustrated in an annealed state for removing the tops of lands 36 before hardening followed by drilling of the counterbore 32 and socket cavity 26.

By the above description there is disclosed novel rock bit cone apparatus produced by the sequence method of carburizing a cone cutter surface for earth boring bits in accordance with the invention. Unlike similar purpose methods utilized in the prior art, which resulted in uncarburized spacing between adjacent inserts having a common circumferential land so as to be non-hardened and subsequently subject to the adverse effects of in-service erosion, the instant invention by contrast resulted in uniform case hardening over the entire cone surface including the land areas between the adjacent inserts. This is achieved while avoiding the detrimental effects of surface cracking in carburized land areas associated with the prior art forced fit insertion of inserts. As a result, the intervening land areas are comparably protected from the adverse effects of erosion during the course of earth boring. Consequently, by a relatively simple procedural change in the processing procedure during manufacture of such cutters, a significant difference in the result has been found to occur. The benefit of such result is the enhanced erosion resistance of the previously exposed surfaces which ultimately translates into a longer life expectancy of the rock bit. This means greater earth penetration before bit replacement is required and consequently a reduction in the overall cost of producing a workable bore hole that can contribute to savings in the overall cost of drilling per se. With the tremendous costs associated with drilling particularly for deep well recovery, such savings can be extremely significant in the overall accounting which dictates the economics associated therewith.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. In the method of manufacturing rock bits for earth boring, the steps comprising:

(a) profiling a cutter blank to define at least one circumferential row on which cutter inserts are to be supported in an interference fit in cavities formed in said circumferential row;

(b) carburizing the cutter blank;

(c) machining a plurality of preselected surface areas of said circumferential row at the locations at which said cavities are to be formed while substantially retaining the carburizing in the remaining areas of said circumferential row, said machining exposing an uncarburized area of said blank slightly greater than the inserts when supported in their respective cavities;

(d) metallurgically hardening the carburized areas of said blank;

(e) forming insert cavities in said circumferential row at locations within said preselected surface areas of transverse dimension less than the corresponding dimension of said inserts; and (f) pressing cutter inserts into said cavities to effect an interference fit spaced from said hardened surface to maintain the surface of said circumferential row substantially free of stress cracking in the areas surrounding said inserts.

2. In the method according to claim 1 in which said step of machining comprises forming a counterbore in said preselected surface areas.

3. In the method according to claim 1 in which said machining step occurs sequentially prior to said hardening step.

4. In the method of forming cutter rock bits for earth boring, the steps comprising:

(a) carburizing the surface of a pre-profiled cutter blank having compact land areas contained in at least one circumferential land row;

(b) counterboring the compact land areas in a pattern commensurate with a placement pattern of inserts to be received, each counterbore being of a dimensional size larger than the corresponding dimension of an insert to be received and extending inward of the land area to a depth below the applied carburizing layer so as to remove the carburizing layer thereat while substantially retaining the carburizing in the remaining areas of said circumferential land row;

(c) hardening the remaining carburized surfaces of said cutter blank;

(d) drilling an insert socket cavity in said compact lands at the previously formed counterbores to a diametral dimension less than said corresponding insert dimensions; and (e) pressing cutter inserts into said drilled cavities to effect an interference fit therewith while maintaining the surface areas of said circumferential land row surrounding said inserts substantially free of stress cracking.

5. In the method according to claim 4 including the step of annealing the cutter blank following the step of carburizing.

6. In the method according to claim 4 in which the steps of counterboring and drilling are performed coaxially in the compact lands of the cutter blank so as to form a counterbore and socket cavity which are concentric to each other and said counterbore is of a size at least greater than the interference fit between said inserts and the respective insert cavities in which said inserts are pressed.

7. In a rotary rock bit having at least one rolling cutter member for forming a borehole in the earth, said rolling cutter member having at least one annular surface containing an annular row of cutter inserts mounted in an interference fit in socket cavities in said annular surface for cutting the inner portions of a borehole, the improvement comprising said annular surface being case hardened to include the land area substantially between adjacent cutter inserts thereon and a narrow substantially concentric band of land area contiguously surrounding each of said insert cavities, said band area being larger than the corresponding dimension of the insert thereat and substantially devoid of case hardening whereby the surface areas of said annular surface surrounding said inserts are substantially free of stress cracking induced by said interference fit.

8. In a rotary rock bit according to claim 7 in which the case hardening contained on the annular row between said inserts is of substantially equal thickness as the case hardening on the remaining areas of said cutter member contiguous to said annular row.

9. In a rotary rock bit according to claims 7 or 8 in which said narrow band comprises a counterbore associated with each of said insert sockets extending radially outward thereof through the circumferential plane of said case hardening.

10. In a rotary rock bit according to claim 9 in which the counterbore extends for a predetermined depth below the outermost surface of said annular row into the composition of the rock bit relatively unhardened as compared to the contiguous surface areas thereabout.

11. In a rotary rock bit according to claim 9 in which the size of each of said counterbores is at least greater than the interference fit of the insert mounted in the respective of said cavities.

12. In a rotary rock bit according to claim 9 in which said counterbore extends for a first predetermined depth below the outermost surface of a compact land area and said socket extends within said counterbore for a second predetermined depth inwardly beyond said first predetermined depth.

13. In a rotary rock bit according to claim 12 in which said counterbores and said associated sockets are arranged substantially concentric to each other about a common axis.

14. In the method of forming earth boring rock bits having compact land areas contained in at least one circumferential land row, the steps comprising:

(a) providing counterbores in the compact land areas in a pattern commensurate with a pattern of inserts to be received and of transverse dimension larger than the corresponding dimension of the inserts;

(b) providing a case hardened surface on said circumferential land rows in the surface areas extending substantially between said counterbores;

(c) providing an insert cavity extending inward of each of said counterbores of transverse dimension less than the corresponding dimension of the inserts; and (d) placing cutter inserts into said cavities to effect an interference fit therewith whereby the surface areas of said circumferential land row surrounding said inserts are substantially free of stress cracking.

15. In the method of forming earth boring rock bits having compact land areas contained in at least one circumferential land row, the steps comprising:

(a) counterboring the compact land areas in a pattern commensurate with a pattern of inserts to be received and of transverse dimension exceeding the corresponding dimension of the inserts;

(b) drilling an insert socket cavity in said compact lands at the previously formed counterbores of diametral dimension less than the corresponding dimension of the inserts;

(c) providing a case hardened surface on said circumferential land rows in the land areas extending substantially between said counterbores; and (d) pressing cutter inserts into said drilled cavities to effect an interference fit therewith whereby the surface areas of said circumferential land row surrounding said inserts are substantially free of stress cracking.

* * * * *